United States Patent [19]

Pape

[11] 4,405,293

[45] * Sep. 20, 1983

[54] COMPRESSOR

[75] Inventor: Wilhelm Pape, Wunstorf, Fed. Rep. of Germany

[73] Assignee: Wabco Fahrzeugbremsen GmbH, Hanover, Fed. Rep. of Germany

[ * ] Notice: The portion of the term of this patent subsequent to Jun. 9, 1998, has been disclaimed.

[21] Appl. No.: 197,448

[22] Filed: Oct. 16, 1980

[30] Foreign Application Priority Data

Nov. 8, 1979 [DE] Fed. Rep. of Germany ..... 2945116

[51] Int. Cl.[3] ..... F04C 21/00

[52] U.S. Cl. ..... 417/482; 92/120

[58] Field of Search ..... 417/481, 482, 483, 484; 123/18 R; 92/120, 121, 122, 123, 124, 125; 91/339, 340

[56] References Cited

U.S. PATENT DOCUMENTS

| | | | |
|---|---|---|---|
| 454,180 | 6/1891 | McLennan | 417/483 |
| 593,809 | 11/1897 | Lockman | 417/483 |
| 1,189,834 | 7/1916 | Kress | 123/18 R |
| 1,468,516 | 9/1923 | Schiller | 123/18 R |
| 2,864,316 | 12/1958 | Verrue | 417/482 |
| 4,272,229 | 6/1981 | Pape | 417/481 |

FOREIGN PATENT DOCUMENTS

| | | | |
|---|---|---|---|
| 577656 | 5/1946 | United Kingdom | 123/18 R |
| 902556 | 8/1962 | United Kingdom | 417/481 |

*Primary Examiner*—Leonard E. Smith
*Attorney, Agent, or Firm*—R. S. Visk

[57] ABSTRACT

An oscillating piston compressor characterized by a spherically contoured piston chamber in which a wedge-shaped disk-like piston is journaled for oscillating motion on an axle journaled in the housing and coinciding with the juncture of a pair of semi-circular sectors forming the piston. A cam formed on the side of the piston opposite the pressure side, is contacted either by a rotating eccentric cam, a crankarm, or a crankpin for imparting oscillating motion to the piston to effect compressing action. A flat circular valve plate, in which intake and exhaust valves are disposed, is fixed transversely in the housing for separating the piston compression chambers from intake and delivery chambers.

3 Claims, 4 Drawing Figures

COMPRESSOR

BACKGROUND OF THE INVENTION

The invention concerns an oscillating piston compressor. Certain oscillating piston compressors have become known as "Dry-Running Compressors" comprising an impeller-like piston axially resting on a piston rod for oscillating back and forth thereon in a cylindrical piston housing. With this known oscillating piston compressor, the piston housing contains at least one radial intermediate wall in order to create a limit for a compression chamber. An isolating or sealing strip arrangement is not effectively feasible with this design, so that compressed air may escape from the compression chamber into the suction or intake chamber. This situation results in a poor degree of compressing efficiency and in uncontrolled temperature variations, especially increase.

Another design of an oscillating piston compressor, more favorable with regard to the packing strip arrangement, is characterized by a spherical housing divided at the area of its largest diameter for the purpose of mounting the rotating piston. Due to such division of the housing, a cumbersome, two-part piston must be used. A unitary piston cannot be used in this last-mentioned type compressor, since it would have to travel over a junction seam. This could lead to rapid wear and possibly even to rupture of the sealing element.

With the last-mentioned oscillating piston compressor, oscillation of the pistons is effected by a hobbing or camming action taking place over steep cam surfaces. This results in a one-sided compression chamber, which leads to unequal thermal stresses of the housing.

In the case of the presently known oscillating piston compressors above described, the operation is complicated because of the housing design. An arrangement of the drive within the housing is not directly possible, so that an economic production and use is not possible without additional expenditure. For this reason, a further known oscillating piston compressor has been proposed in which the radial intermediate walls are eliminated, so that a piston having semi-circular sectors may be used advantageously with a spherically-shaped housing having a correspondingly spherically-shaped interior chamber, and in which housing the drive arrangement may be accommodated.

To attain the aforementioned advantage, the further known oscillating piston compressor is characterized by the following features:

(a) a blade-like disk, oscillating back and forth in the housing inner chamber on a bearing axle, whose oscillating movement is effected by means of a drive, forms the oscillating piston;

(b) the blades of the oscillating piston making sealing contact with the inner spherical surface of the housing, form two compression chambers in cooperation with the internal surface of the housing inner chamber and the valve plate;

(c) charging of the compression chambers takes place from the atmosphere by means of inlet valves or scavenging ports;

(d) delivery of compressed air from compression chambers to the devices using the compressed air takes place via pressure valves;

(e) the cylinder bearing surface is designed spherically and does not have juncture seams in the area of contact by oscillating movement of the piston which is complementarily designed to correspond to the spherical radius of the housing;

(f) the bearing axle of the oscillating piston represents the geometric center point of the sphere diameter;

(g) the compression chambers, limited by the intermediate wall, designed as a valve plate, and by the surfaces of the piston, are each semi-circularly wedge-shaped.

With the oscillating piston compressor immediately above described, the wedge shape of the compression chambers necessarily results from the wedge-shaped or angled cover-valve plate, while the piston represents a uniform disk having a circular peripheral support surface. The spherical recess in the cylinder housing required by the wedge shape of the cover-valve plate provides an elliptical sealing surface, due to which, difficulties can originate with the manufacture thereof and which can also affect the manufacture of the cover-valve plate and the cylinder cover.

SUMMARY OF THE INVENTION

It is the object of the present invention, therefore, to improve the oscillating piston compressor mentioned at the outset with simple means so that the indicated production difficulties can be eliminated. This problem is solved by the present invention in the manner set forth below.

The design of the cover-valve plate in a flat form results in a flat sealing surface between the cylinder housing and the cover-valve plate, which is more favorable for production cost, and creates no problems with respect to sealing. On the other hand, no essential difference exists in producing the oscillating piston in angled form as compared to producing it in a flat form.

The invention can be advantageously used commercially in the small compressor range, e.g., in dentistry, compressed air tools or as a combination vacuum pump-/air compressor.

BRIEF DESCRIPTION OF THE DRAWINGS

The invention is represented in the drawings, in which.

DESCRIPTION AND OPERATION

Figure 1:
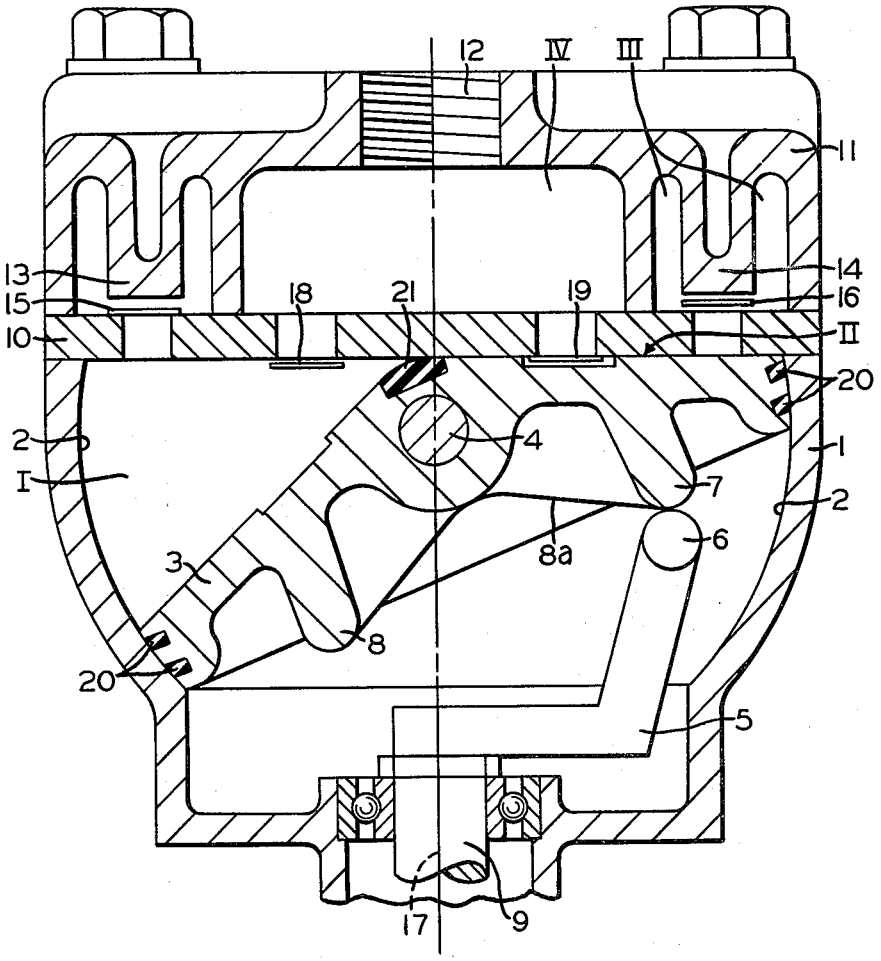
FIG. 1 is an elevational view, in section, showing an oscillating piston compressor with a crankshaft pin as the drive means.

According to FIG. 1, an oscillating piston compressor embodying the invention, comprises a housing 1 with a substantially semi-spherical inner chamber, the outside contour of which housing can be round or angular while said inner chamber is characterized by a spherical inner contour 2 in that portion in which oscillating motion of a wedge-shaped oscillating piston 3 occurs. The geometric center point of the inner contour 2 is designed to coincide with the axis of a bearing axle 4 of the oscillating piston 3. Bearings (not shown) for the oscillating piston bearing axle 4, may be fixed either in housing 1 or in the oscillating piston 3. On the one side of oscillating piston 3, there is a crankarm 5 having a follower 6 secured at the end thereof and, as shown in FIG. 1, in contact with one (7) of two high points or elevations 7 and 8 of a cylindrical undulating cam surface 8*a* of the oscillating piston 3.

The oscillating motion of piston 3 about the axis of axle 4 is effected by means of a driveshaft 9 rotatably journaled in housing 1. On the side of the oscillating piston 3 opposite crankarm 5, there is a valve plate 10, which is clamped between the cylinder housing 1 and a cylinder head 11 provided with a delivery connection (not shown) and an intake or suction connection 12. Cross members 13 and 14 of cylinder head 11 form two exhaust or delivery valves 10-15 and 10-16 correlated with respective compression chambers I and II, and with valve plate 10 and exhaust disk valves 15 and 16, whereby compression chambers I and II are defined by the areas of oscillating piston 3 disposed on both sides of a center vertical axis 17, contour surface 2, and valve plate 10. Between the cylinder head 11 and valve plate 10, there is a common pressure delivery chamber III opening to a delivery connection (not shown) leading to fluid pressure devices using the fluid pressure generated by the compressor.

Compression chambers I and II are connected with respective intake valves 10-18 and 10-19, comprising intake disk valves 18 and 19 and valve plate 10, to common intake connection 12 via chamber III. Sealing of compression chambers I and II between the rotating piston 3 and the circular arc 2 is achieved by annular sealing elements 20 and a packing strip 21 diametrically disposed in the apex juncture of the two halves of piston 3.

Compressing operation of the compressor shown in FIG. 1 is effected by rotation of crankshaft 9 and therefore rotation of crankarm 5. Follower 6 imparts motion to cam surface 8*a* and oscillation of piston 3.

Figure 2:
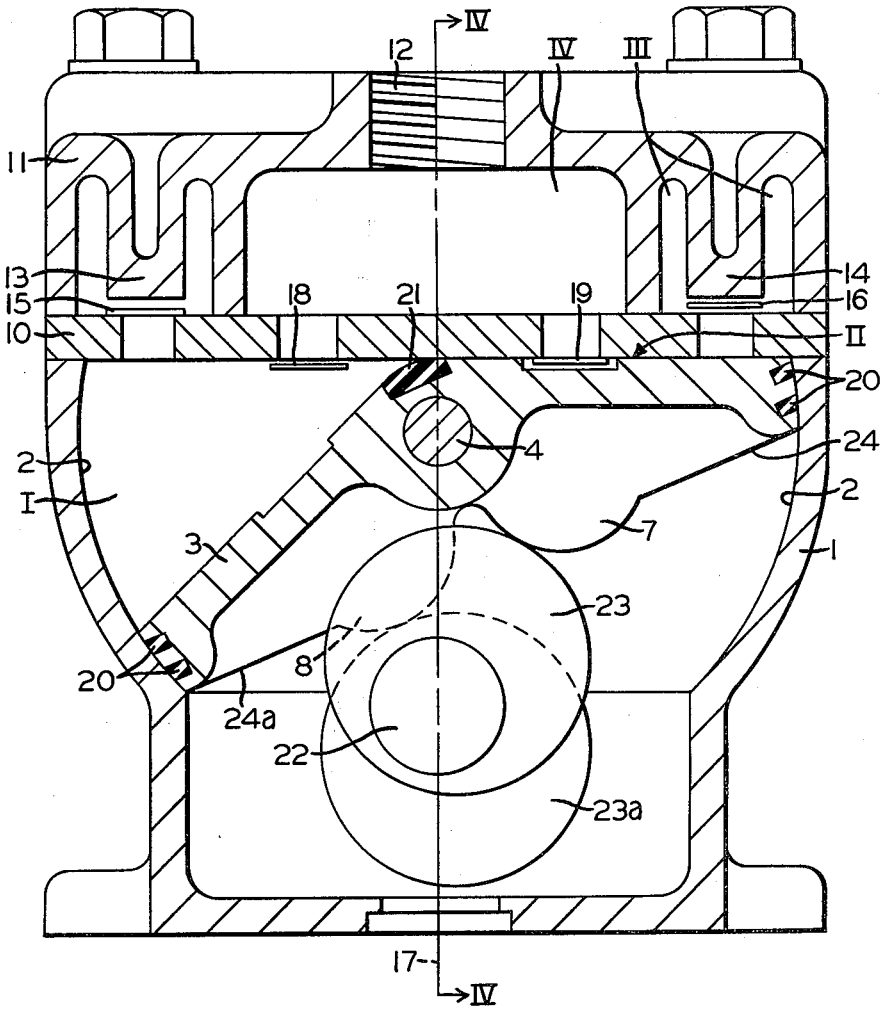
FIG. 2 is an elevational view, in section, showing an oscillating piston compressor with a camshaft as the drive means.
Figure 3:
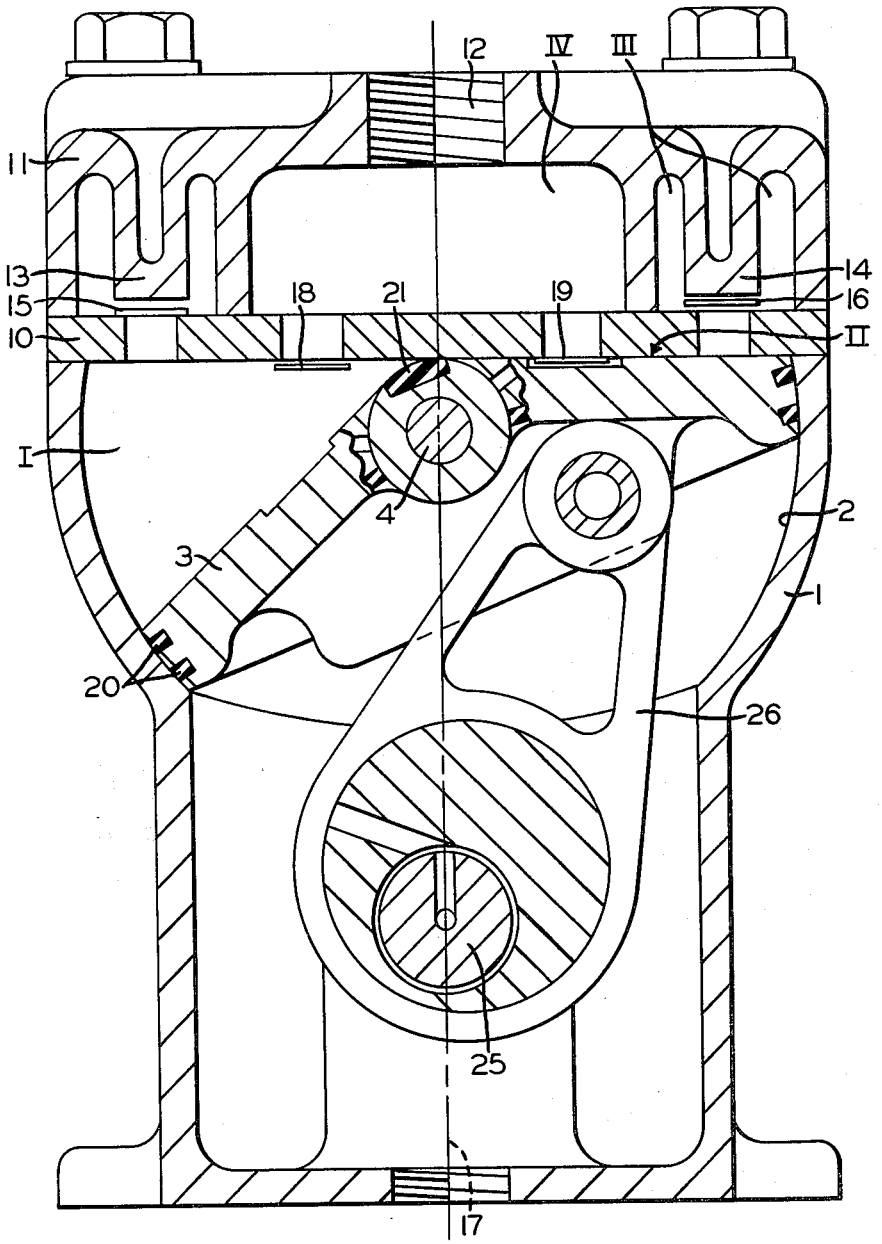
FIG. 3 is an elevational view, in section, showing an oscillating piston compressor, with a crankshaft and piston rod as the drive means.

The basic design of the oscillating piston compressor shown in FIG. 2 is practically the same as that of the compressor shown in FIG. 1, except that the driving means comprises a camshaft 22 rotatably journaled in housing 1. A pair of eccentric cams 23 and 23*a* are carried at 180° relative to each other on camshaft 22 and ride on diametrically disposed undulated cam surfaces 24 and 24*a*, respectively, formed on the underside of piston 3 to impart oscillating motion to said piston upon rotation of the camshaft. FIG. 3 also corresponds basically to the basic design shown in FIG. 1, except that the drive means comprises a crankshaft 25 having one end of a crankpin 26 eccentrically mounted thereon with the other end of said crankpin rotatably connected to one sector of piston 3 for imparting oscillating motion thereto upon rotation of said crankshaft.

The function of the oscillating piston compressor is as follows:

Atmospheric air flows through the housing opening 12 into a supply chamber IV and is drawn into pressure chamber I or II through suction valve 10-18 or 10-19, so that piston 3 is moved in the direction of the lower dead center position. The compressed air produced by oscillation of piston 3 from the lower dead center position to an upper dead center position, as effected through the connection between crankshaft 25 and crankpin 26, flows through exhaust valve 10-15 or 10-16 to delivery chamber III and from there through housing opening 12 to the pressure operable devices (not shown).

The oscillating piston machine, described here in the form of a compressor, as design example, can be designed further with the same chamber arrangement as a combustion machine.

Figure 4:
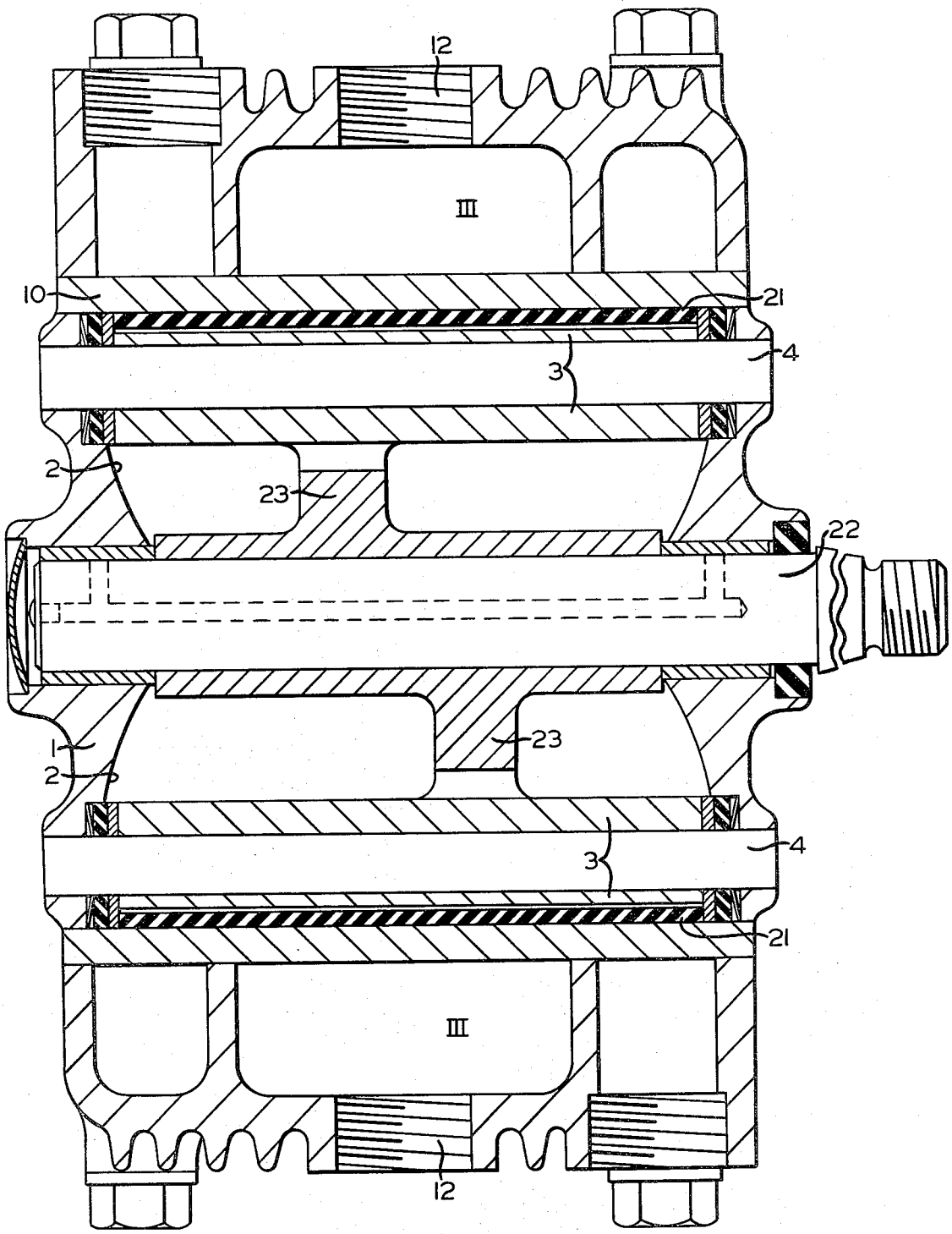
FIG. 4 is an elevational sectional view taken along line IV—IV looking in the direction indicated and showing a double oscillating piston compressor in a double cylinder housing with camshaft drive.

The oscillating piston compressor may be designed as a dual or compound compressor with a common camshaft drive, as shown in FIG. 4, or with a crankshaft drive, even making it possible to have a four-, six-, or multi-chambered compressor by connecting on further double-chamber oscillating piston compressors, whereby such a series of compressors makes possible an arrangement of the cylinders in rows and a rotation free connection of the camshaft or the crankshaft, and with such design, the cylinders lie opposite each other and the oscillating pistons may be actuated by a common camshaft or crankshaft.

Having now described the invention, what I claim as new and desire to secure by Letters Patent, is:

1. An oscillating piston compressor comprising:

(a) a housing having a substantially semi-spherical piston chamber characterized by a seamless surface, (b) a disk-shaped piston comprising a pair of semi-circular sectors joined in angular relation to each other and oscillatingly disposed in said piston chamber on a bearing axle journaled in the housing in axial coincidence with the greatest diameter thereof and with the line of juncture of said pair of semi-circular sectors, the geometric centerpoint of said spherical chamber coinciding with the midpoint of the axis of said axle, (c) sealing means disposed peripherally on said piston for making sealing contact with said seamless surface during oscillating movement of the piston, (d) a circular flat valve plate fixed transversely in said housing so as to separate said piston chamber adjacent one side thereof from an air supply chamber and a pressure delivery chamber adjacent the opposite side thereof, said one side axially spaced from such geometric centerpoint of said spherical chamber, (e) said piston chamber having formed therein a pair of compression chambers sealingly isolated from each other and defined by said valve plate, said housing, and said piston sectors on opposite sides of said bearing axle, respectively, (f) each of said compression chambers being alternately communicated with said supply chamber and delivery chamber, via respective intake and delivery valves operably disposed in said valve plate, by oscillatory movement, and (g) driving means for imparting oscillatory movement to said piston, wherein said driving means is diposed within said housing and said driving means further comprises a cylindrical undulated cam surface formed on the side of said piston opposite said compression chambers, a crankarm having a follower in rolling contact with said cam surface, and a rotatable drive-shaft carrying said crankarm for imparting rotating motion thereto on said cam surface.

2. An oscillating piston compressor, as set forth in claim 1, wherein said undulated cam surface is characterized by a pair of high points formed on diametrically opposite sides of said driveshaft so as to impart said oscillating motion to said piston.

3. An oscillating piston compressor, as set forth in claim 2, wherein said pair of high points are disposed at 90° relative to two diametrically opposite low points.

* * * * *